US009278747B2

(12) United States Patent
Kuriyagawa et al.

(10) Patent No.: US 9,278,747 B2
(45) Date of Patent: Mar. 8, 2016

(54) OUTBOARD MOTOR CONTROL APPARATUS

(71) Applicant: HONDA MOTOR CO., LTD., Minato-Ku, Tokyo (JP)

(72) Inventors: Koji Kuriyagawa, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 101 days.

(21) Appl. No.: 14/079,016

(22) Filed: Nov. 13, 2013

(65) Prior Publication Data

US 2014/0141663 A1 May 22, 2014

(30) Foreign Application Priority Data

Nov. 16, 2012 (JP) ..... 2012-252734

(51) Int. Cl.

| | |
|---|---|
| ***B63H 20/14*** | (2006.01) |
| ***B63H 25/00*** | (2006.01) |
| ***B63H 20/20*** | (2006.01) |
| ***F02B 61/04*** | (2006.01) |
| ***F02D 41/02*** | (2006.01) |
| *B63H 25/42* | (2006.01) |
| *B63H 20/00* | (2006.01) |
| *F02D 31/00* | (2006.01) |

(52) U.S. Cl.

CPC ..... *B63H 25/00* (2013.01); *B63H 20/20* (2013.01); *F02B 61/045* (2013.01); *F02D 41/021* (2013.01); *B63H 20/14* (2013.01); *B63H 25/42* (2013.01); *B63H 2020/003* (2013.01); *F02D 31/001* (2013.01); *F02D 2200/101* (2013.01); *F02D 2200/701* (2013.01)

(58) Field of Classification Search

CPC ..... B63H 21/265; B63H 25/42; B63H 25/46; B63H 5/125; B63H 20/12; B63H 20/16; F02B 61/045

USPC ..... 440/75, 86

See application file for complete search history.

(56) References Cited

U.S. PATENT DOCUMENTS

| | | | | |
|---|---|---|---|---|
| 6,234,856 | B1 | 5/2001 | Woolley | |
| 7,419,413 | B2 * | 9/2008 | Mizuguchi et al. | 440/84 |
| 7,438,013 | B2 | 10/2008 | Mizutani | |
| 8,428,801 | B1 * | 4/2013 | Nose et al. | 701/21 |

FOREIGN PATENT DOCUMENTS

JP 2007-091115 A 4/2007

OTHER PUBLICATIONS

Canadian Office Action issued Jun. 23, 2014 in the corresponding CA Patent Application 2,833,441.

* cited by examiner

*Primary Examiner* — S. Joseph Morano
*Assistant Examiner* — Andrew Polay
(74) *Attorney, Agent, or Firm* — Carrier Blackman & Associates, P.C.; William D. Blackman; Jeffrey T. Gedeon

(57) ABSTRACT

In an apparatus for controlling operation of two outboard motors mounted on a stern of a boat side by side and each equipped with an internal combustion engine to power a propeller through a power transmission shaft and a transmission having a forward first-speed and a second-speed gear and a reverse gear supported on the power transmission shaft, control is conducted at turning of the boat to operate the inner one of the outboard motors to transmit the engine power to the propeller through the reverse gear, and to operate the outer one of the outboard motors to transmit the engine power to the propeller through the forward first-speed gear, when the detected engine speed is equal to or smaller than a predetermined first speed and the detected rudder angle is equal to or greater than a predetermined angle.

14 Claims, 10 Drawing Sheets

OUTBOARD MOTOR CONTROL APPARATUS

BACKGROUND

1. Technical Field

Embodiment of the invention relates to an outboard motor control apparatus, more particularly to a control apparatus for a plurality of outboard motors installed on a boat (ship).

2. Background Art

With reference to a boat installed with a plurality of outboard motors at its stern side by side, there has been proposed a technique to regulate outputs of respective outboard motors in response to navigation conditions such as a navigation speed so as the boat to make turning smoothly, for example, by Japanese Laid-Open Patent Application No. 2007-091115.

Specifically, in the reference, the outputs of the outboard motors are controlled such that, when a rudder angle is made large for turning, a thrust of the inner motor is decreased, while that of the outer motor is increased so as to make the angular moment about the center of turning great, thereby enabling to make turning in a small radius. In the reference, it is also suggested to make turning smoothly by exerting the thrust of the inner motor in the direction of reverse.

SUMMARY

Aside from the above, at a time of trolling or the like, it is sometimes needed to make rapid turning in a small radius or to make repeated turning about a same point. However, it is difficult to make such turning smoothly from the teaching of the techniques mentioned in the reference.

An object of embodiment of the invention is therefore to overcome the foregoing drawback by providing a control apparatus for outboard motors installed on a boat that facilitates to make rapid turning or repeated turning about a same point.

In order to achieve the object, this invention provides in a first aspect an apparatus for controlling operation of a plurality of outboard motors adapted to be mounted on a stern of a hull of a boat side by side and each equipped with an internal combustion engine to power a propeller through a power transmission shaft and a transmission having at least a forward first-speed gear and a second-speed gear and a reverse gear each supported on the power transmission shaft, comprising: an engine speed detector that detects a speed of the engine of a first one of the outboard motors situated at inner side at turning of the boat; a rudder angle detector that detects a rudder angle of at least one of the outboard motors including the first one and a second one situated at outer side at the boat turning; a controller that conducts control of the boat turning to operate the first one of the outboard motors to transmit a power of the engine to the propeller through the reverse gear, and to operate the second one of the outboard motors to transmit the power of the engine to the propeller through the forward first-speed gear, when the detected engine speed is equal to or smaller than a predetermined first speed and the detected rudder angle is equal to or greater than a predetermined angle.

In order to achieve the object, this invention provides in a second aspect a method for controlling operation of a plurality of outboard motors adapted to be mounted on a stern of a hull of a boat side by side and each equipped with an internal combustion engine to power a propeller through a power transmission shaft and a transmission having at least a forward first-speed gear and a second-speed gear and a reverse gear each supported on the power transmission shaft, comprising the steps of: detecting a speed of the engine of a first one of the outboard motors situated at inner side at turning of the boat; detecting a rudder angle of at least one of the outboard motors including the first one and a second one situated at outer side at the boat turning; and conducting control of the boat turning to operate the first one of the outboard motors to transmit a power of the engine to the propeller through the reverse gear, and to operate the second one of the outboard motors to transmit the power of the engine to the propeller through the forward first-speed gear, when the detected engine speed is equal to or smaller than a predetermined first speed and the detected rudder angle is equal to or greater than a predetermined angle.

BRIEF DESCRIPTION OF THE DRAWINGS

The above and other objects and advantages of embodiments of the invention will be more apparent from the following description and drawings in which.

DESCRIPTION OF EMBODIMENT

Embodiment of an outboard motor control apparatus according to the invention will now be explained with reference to the attached drawings.

Figure 1:
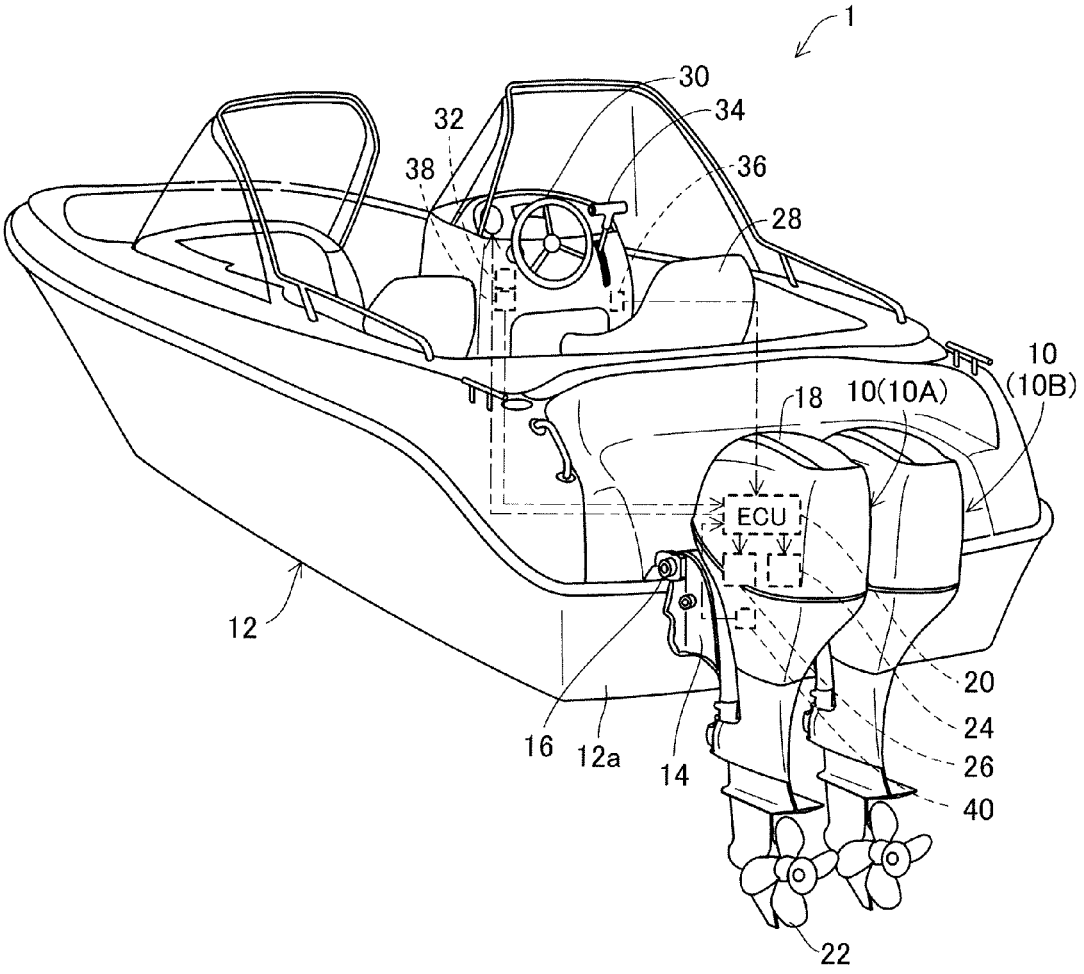
FIG. 1 is an overall schematic view of outboard motors installed on a boat to which an outboard motor control apparatus according to an embodiment of the invention is applied.

FIG. 1 is an overall schematic view of outboard motors installed on a boat according to the embodiment of the invention.

In FIG. 1, symbol 1 indicates a boat (ship) whose hull 12 is mounted with a plurality of outboard motors 10 side by side, specifically two outboard motors comprising an outboard motor 10A installed at the port (left hand side as the operator faces forward toward the bow; hereinafter referred to as "first outboard motor"), and an outboard motor 10B installed at the starboard (right hand side in that direction; hereinafter referred to as "second outboard motor").

Since the first and second outboard motors 10A, 10B have the same structure, they will generally be explained in the following as the outboard motors 10, unless otherwise mentioned.

As illustrated, the outboard motor 10 is clamped (fastened) to the stern or transom 12*a* of the hull 12, through stern brackets 14 and a tilting shaft 16.

The outboard motor 10 has an internal combustion engine (prime mover; not shown in FIG. 1) and an engine cover 18 that covers the engine. The engine cover 18 accommodates, in addition to the engine, in its interior space (engine room) an Electronic Control Unit (ECU) 20. The ECU 20 has a microcomputer constituted by a CPU, ROM, RAM and other devices, and functions as an outboard control apparatus for controlling the operation of the outboard motor 10.

The outboard motor 10 is provided with a transmission (automatic transmission) 24 that is installed at a drive shaft for transmitting the engine power to a propeller 22 and a power tilt/trim unit (hereinafter referred to as "trim unit") 26. The transmission 24 has a plurality of gears including the first-speed gear and the second-speed gear and transmits the engine power through the selected gear to the propeller 22. The trim unit 26 is adapted to regulate a tilt/trim angle of the outboard motor 10 relative to the hull 12 by tilting up/down or trimming up/down. The operation of the transmission 24 and trim unit 26 is controlled by the ECU 20.

A steering wheel 30 is installed near a cockpit (operator's seat) 28 of the hull 12 to be rotatably manipulated by the operator. A steering angle sensor 32 is attached on a shaft (not shown) of the steering wheel 30 and produces an output or signal corresponding to the steering angle applied or inputted by the operator through the steering wheel 30.

A shift/throttle lever (shift lever) 34 is provided near the cockpit 28 to be manipulated by the operator. The shift/throttle lever 34 can be moved or swung in the front-back direction from the initial position and is used by the operator to input a shift command (switch command among forward, reverse and neutral) and an engine speed command. A lever position sensor (shift/throttle lever position sensor) 36 is installed near the shift/throttle lever 34 and produces an output or signal corresponding to a position of the shift/throttle lever 34.

A GPS receiver 38 is provided at an appropriate location of the hull 12 to receive a Global Positioning System signal and produces an output or signal indicative of the positional information of the boat 1 obtained from the GPS signal. The outputs of the steering angle sensor 32, lever position sensor 36 and GPS receiver 38 are sent to the ECU 20.

In addition, a rudder angle sensor 40 is installed at an appropriate location and produces an output or signal indicative of a rudder angle θ of the outboard motor 10 relative to the hull 12. The outputs of the rudder angle sensor 40 are inputted to the ECU 20.

Figure 2:
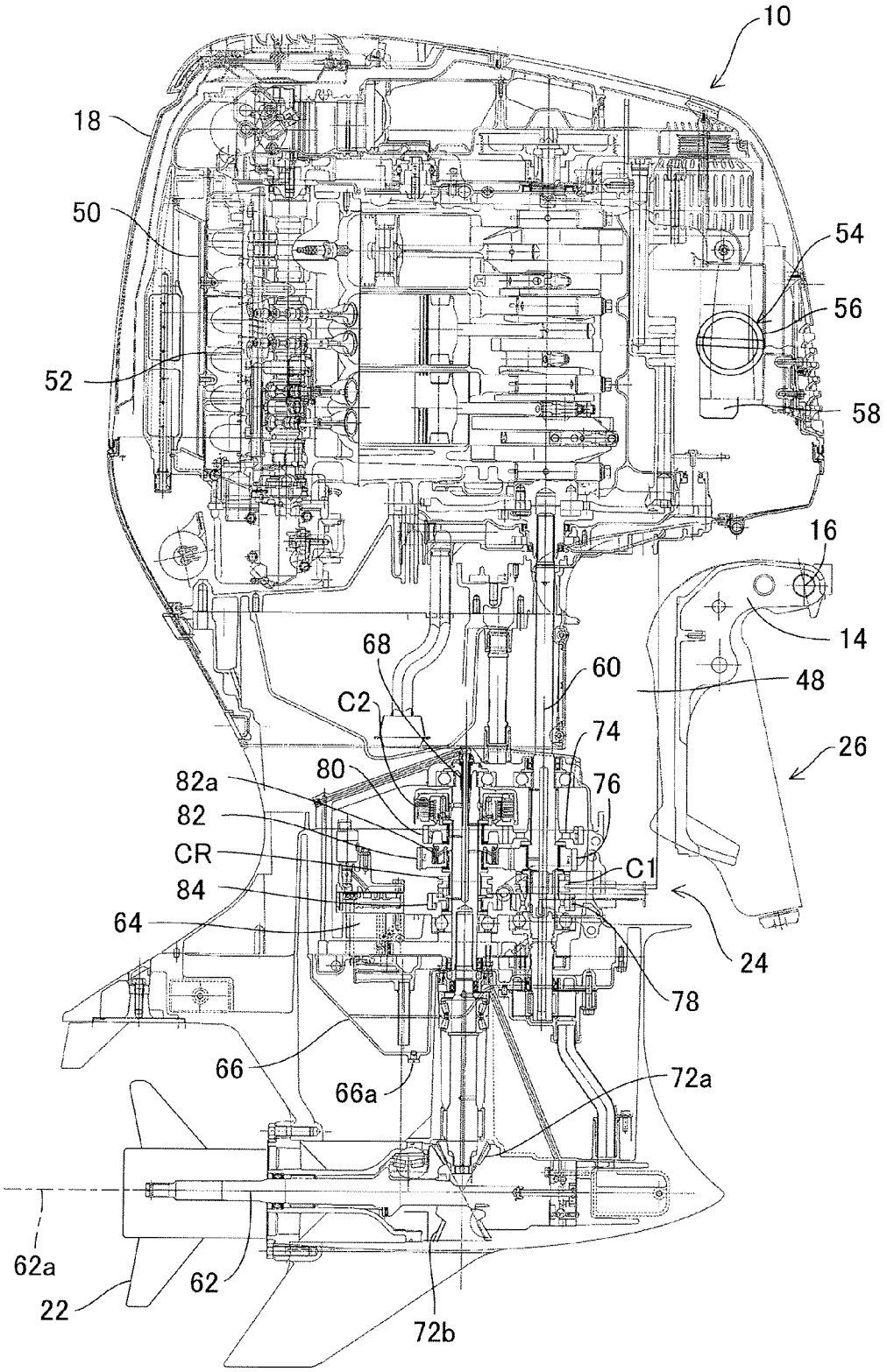
FIG. 2 is an enlarged sectional side view showing the outboard motor shown in FIG. 1.
Figure 3:
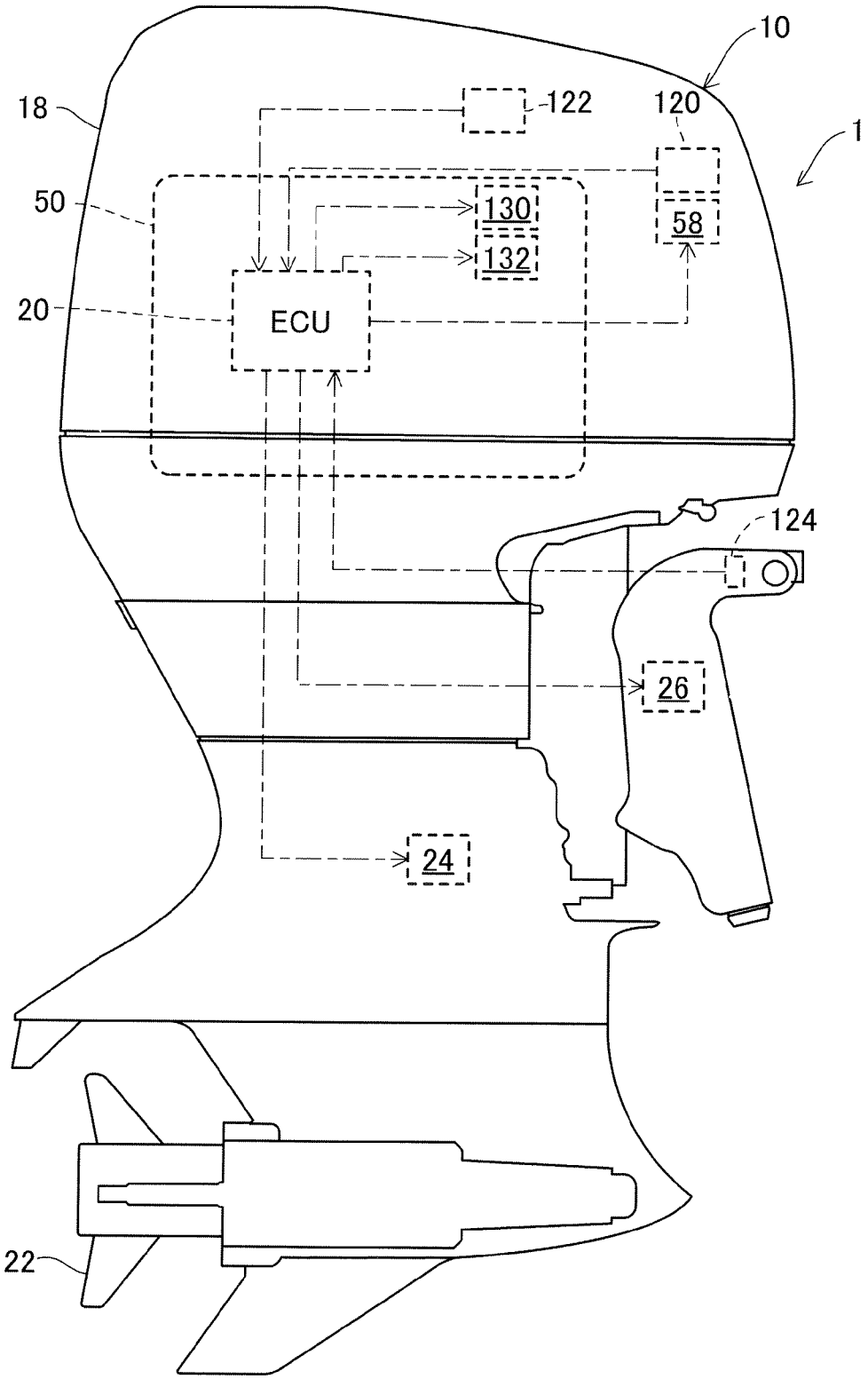
FIG. 3 is an enlarged side view of the outboard motor shown in FIG. 1.
Figure 4:
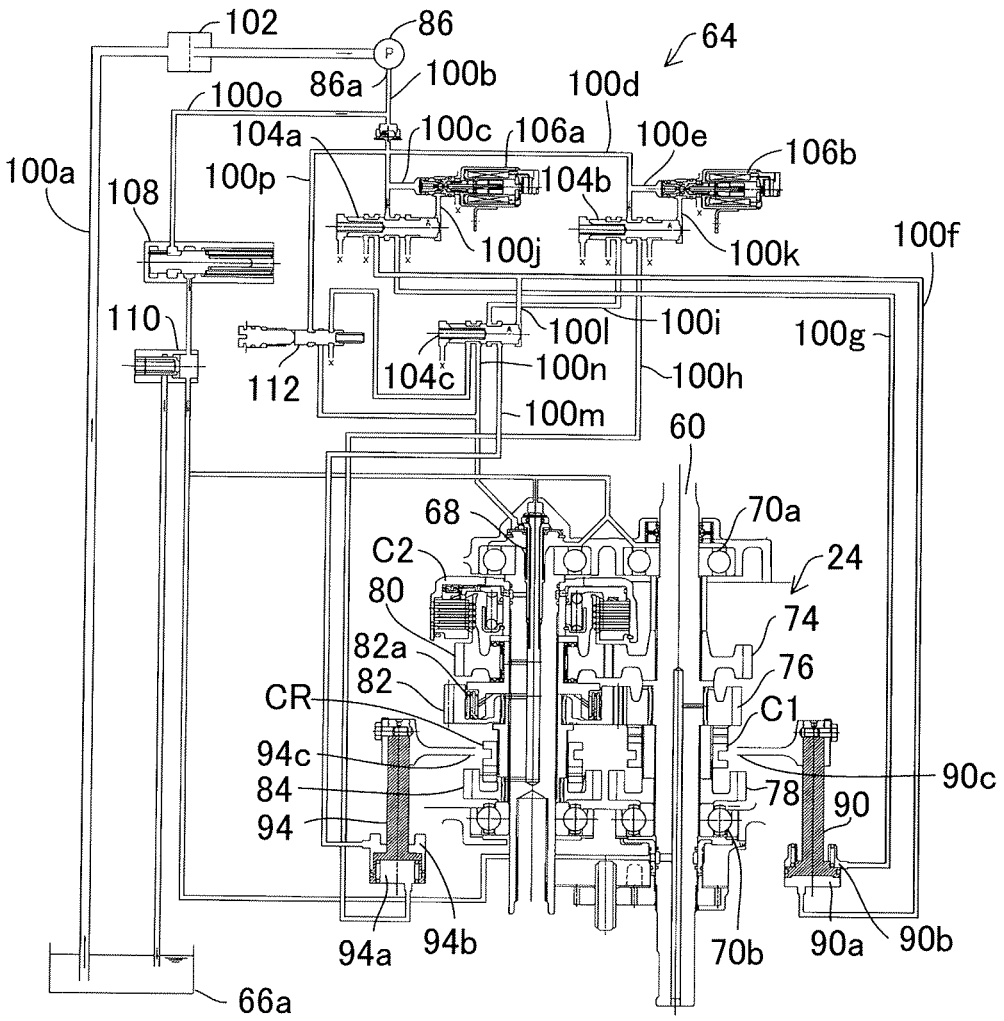
FIG. 4 is a hydraulic circuit diagram schematically showing a hydraulic circuit of a transmission mechanism shown in FIG. 2.

FIG. 2 is an enlarged sectional side view partially showing the outboard motor 10 shown in FIG. 1, FIG. 3 is an enlarged side view of the outboard motor 10 shown in FIG. 1, and FIG. 4 is a hydraulic circuit diagram schematically showing a hydraulic circuit of the transmission 24.

As shown in FIG. 2, the outboard motor 10 is clamped to the stern 12*a* of the hull 12, through the stern brackets 14, the tilting shaft 16 and a swivel case 48. The trim unit is provided at a location close to the swivel case 48 and stern brackets 14.

The trim unit 26 has a hydraulic cylinder for tilt angle regulation, a hydraulic cylinder for trim angle regulation and electric motors each connected to the hydraulic cylinders through a hydraulic circuit (neither shown). In the trim unit 26, the electric motors are driven by a tilt up/down signal or a trim up/down signal sent from the ECU 20 to supply a hydraulic oil (pressure) to the cylinder concerned so as to extend/contract the same.

With this, the swivel case 48 is rotated about the tilting shaft 16 so that the outboard motor 10 is tilt up/down (and trim up/down) relative to the hull 12. The electric motors in the trim unit 26 are duty-ratio controlled (Pulse Width Modulation control) and a change amount of trim angle per unit time in trim up/down, i.e., the trim speed is stepwise or continuously changed.

The outboard motor 10 is installed at its upper portion with the aforesaid engine (now assigned by symbol 50). The engine 50 comprises a spark-ignition, water-cooled, gasoline engine with a displacement of 2,200 cc. The engine 50 is located above the water surface, and is covered by the engine cover 18.

An air intake pipe 52 of the engine 50 is connected to a throttle body 54. The throttle body 54 has a throttle valve 56 installed therein and an electric throttle motor 58 for opening and closing the throttle valve 56 is integrally disposed thereto. The output shaft of the throttle motor 58 is connected to the throttle valve 56 via a speed reduction gear mechanism (not shown). The throttle motor 58 is operated to open and close the throttle valve 56, thereby regulating a flow rate of air sucked into the engine 50 to control the engine speed.

The outboard motor 10 is provided with a main shaft (input shaft; corresponding to the aforesaid drive shaft) 60 that is rotatably supported in parallel with a vertical axis and its upper end is connected to the crankshaft (not shown) of the engine 50, and a propeller shaft (the aforesaid drive shaft) 62 that is rotatably supported in parallel with a horizontal axis and its lower end is connected to the propeller 22.

The aforesaid transmission 24 having the first-speed and second-speed forward gears and the reverse gear is provided at a location between the main shaft 60 and the propeller shaft 62. The power of the engine 50 is transmitted to the propeller 22 through the main shaft 60, transmission 24 and the propeller shaft 62.

The propeller shaft 62 is fixed to the outboard motor 10 in such a manner that its axis 62*a* is substantially parallel to the forward direction of the boat 1 when the trim unit 26 is at its initial state, i.e., the trim angle is the initial angle (zero degree).

At a rear position of the transmission 24 in the forward moving direction of the hull 12 (left of the transmission 24 in FIG. 2), there is provided a valve unit 64 comprising a plurality of hydraulic valves to be used for controlling the transmission 24. The valve unit 64 and a part of the main shaft 60 is contained in a case 66, and the lower portion of the case 66 functions as an oil pan (reservoir) 66*a*.

As shown in FIGS. 2 and 4, the transmission 24 is constituted as a parallel-axis type conventional stepped ratio transmission comprising the aforesaid main shaft (input shaft) 60, a countershaft (output shaft) 68 disposed in parallel with the main shaft 60 and connected thereto through a plurality of gears. The main shaft 60 and countershaft 68 are each supported in the case 66 through a pair of bearings 70*a*, 70*b*. The countershaft 68 is connected (coupled) to the propeller shaft 62 at its distal end (the lower end in FIG. 2) through a pinion gear 72*a* and a bevel gear 72*b*.

The main shaft 60 is provided (from the top in FIG. 2) with a main second-speed gear 74 nonrotatably supported thereon, a main first-speed gear 76 rotatably supported thereon, a first-speed gear clutch (made of a mechanical dog clutch) C1 nonrotatably but longitudinally movably supported thereon and a main reverse gear 78 nonrotatably supported thereon, while the countershaft 68 is provided with a second-speed gear clutch (made of a hydraulic clutch) C2 nonrotatably but longitudinally movably supported thereon, a counter second-speed gear 80 rotatably supported thereon and meshed with the main second-speed gear 74, a counter first-speed gear 82 irrotatably supported thereon and meshed with the main first-speed gear 76, a reverse gear clutch (mechanical dog clutch) CR nonrotatably but longitudinally movably supported thereon and a counter reverse gear 84 rotatably supported thereto and meshed with the main reverse gear 78.

When the first-speed gear clutch C1 is moved in one longitudinal direction, i.e., in the upper direction in the figure, for a predetermined distance, it coupled with the main first-speed gear 76 and engages (fastens) the gear 76 on the main shaft 60 to establish the first speed.

When the second-speed gear clutch C2 is supplied with the hydraulic oil (pressure) from a hydraulic oil pump 86 (driven by the engine 50), it engages (fastens) the counter second-speed gear 80 on the countershaft 68 to establish the second speed.

When the reverse gear clutch CR is moved in one longitudinal direction, i.e., in the lower direction in the figure, for a predetermined distance, it coupled with the counter reverse gear 84 and engages (fastens) the counter reverse gear 84 on the countershaft to establish the reverse.

The counter first-speed gear 82 is installed with one-way clutch 82*a* that releases (decouples) the counter first-speed gear 82 from the countershaft 68 when the rotational speed of the main shaft 60 becomes equal to or greater than a predetermined rotational speed while the main first-speed gear 76 has been engaged with the main shaft 60. In other words, while the rotational speed of the main shaft 60 is relatively low, the power of the engine 50 is transmitted to the propeller 22 by the main first-speed gear 76 and the counter first-speed gear 82, but when the rotational speed of the main shaft 60 increases, the engagement of the counter first-speed gear 82 and the shaft 68 is released.

As shown in FIG. 4, the first-speed gear clutch C1 is connected to a first-speed gear shift actuator 90 through a shift fork 90*c*. The first-speed gear shift actuator 90 is a hydraulic actuator that can extend or contract and when it extends, it moves the first-speed gear clutch C1 in a longitudinal direction of the main shaft 60, while, when it contracts, it move the clutch C1 in a direction opposite thereto.

Specifically, when the actuator 90 is supplied with the hydraulic oil in its oil chamber (for extension) 90*a*, it extends and moves the shift fork 90*c* and the clutch C1 upwardly (in the figure). Moving for a predetermined distance, the clutch C1 is coupled with the main first-speed gear 76. On the other hand, when the actuator 90 is supplied with hydraulic oil in its oil chamber (for contraction) 90*b*, it contracts and moves the clutch C1 downwardly to a neutral position where the clutch C1 is coupled with no gears.

When the first-speed gear clutch C1 is coupled with the main first-speed gear 76, since the gear 76 is engaged on the main shaft 60, the gear 76 rotates with the main shaft 60.

Figure 5:
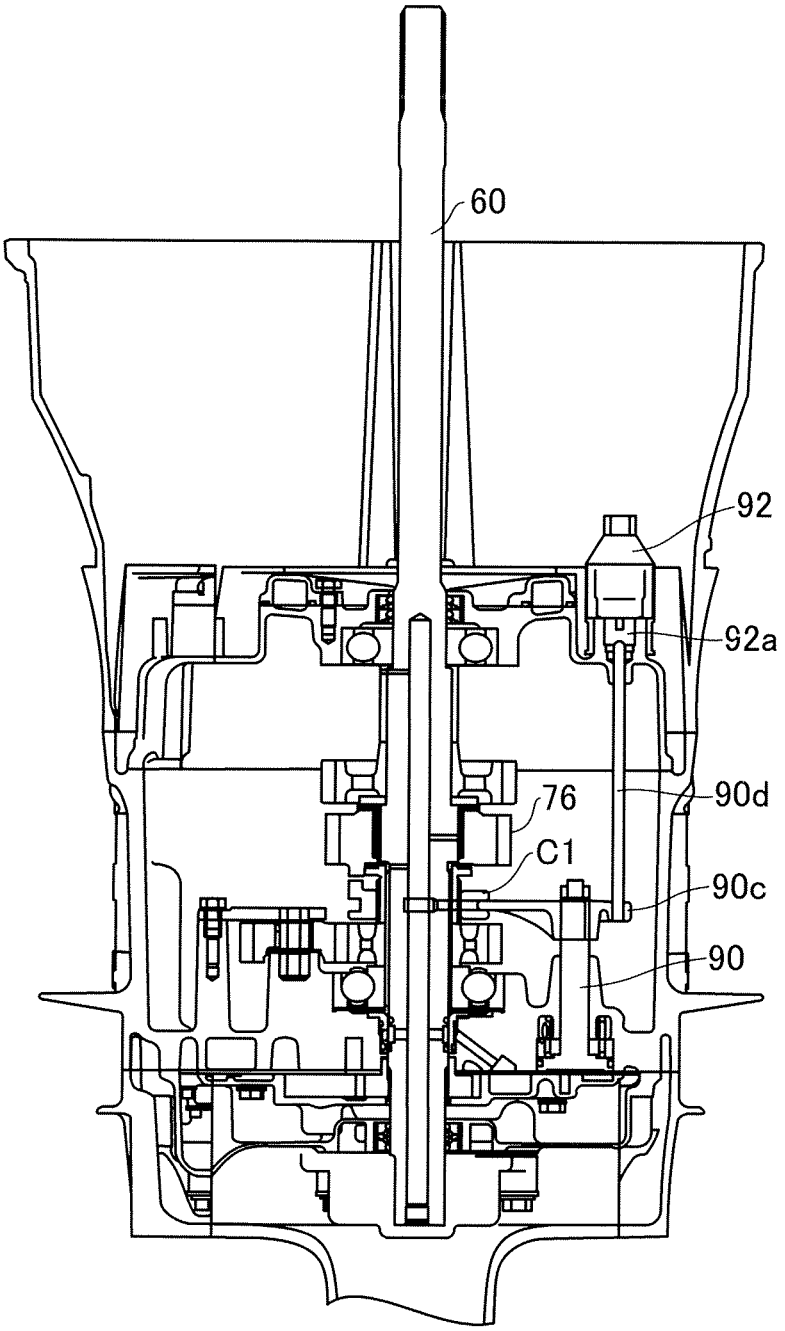
FIG. 5 is an enlarged sectional side view partially showing the outboard motor illustrated in FIG. 2.

FIG. 5 is an enlarged sectional side view partially showing the outboard motor 10 illustrated in FIG. 2.

As shown in the figure, a forward shift switch 92 is installed and produces a signal or output that indicates the coupling of the first-speed gear clutch C1 with the main first-speed gear 76.

The forward shift switch 92 is installed at a location above the shift fork 90*c* of the first-speed gear shift actuator 90 as shown in FIG. 5. Specifically, it is fastened to an upper distal end of an operation rod 90*d* that is connected to the shift fork 90*c* of the actuator 90 in parallel with the main shaft 60.

The forward shift switch 92 has a head portion 92*a* at its lower side in the figure. Specifically, the head portion 92*a* is provided at a position slightly remote from the upper distal end of the operation rod 90*d* in such a manner that, when the first-speed gear shift actuator 90 is extended for the predetermined distance, the head portion 92*a* is brought into contact with the upper distal end of the operation rod 90*d* and is displaced by the same.

The head portion 92*a* is connected to a connector portion (not shown) housed in the forward shift switch 92 and in response to the displacement, the connector portion produces an (electrical) ON signal or output. Thus, when the first-speed gear shift actuator 90 is extended, the first-speed gear clutch C1 is coupled with the main first-speed gear 76 so that the upper distal end of the operation rod 90*d* is brought into contact with the head portion 92*a*, the forward shift switch 92 outputs the ON signal from its connector portion. By monitoring the signal outputted from the switch 92, it becomes possible to determine whether the first-speed gear clutch C1 is coupled with the main first-speed gear 76.

Returning to the explanation of FIG. 4, the reverse gear clutch CR is connected to a reverse shift actuator 94. Similar to the first-speed gear shift actuator 90, the reverse shift actuator 94 is also a hydraulic actuator that can extend or contract and when it extends, it moves the reverse gear clutch CR in a longitudinal direction of the countershaft 68, while, when it contracts, it move the clutch CR in a direction opposite thereto.

Specifically, when the actuator 94 is supplied with the hydraulic oil in its oil chamber (for contraction) 94*b*, it contracts and moves the shift fork 94*c* and the clutch CR downwardly. Moving for a predetermined distance, the clutch CR is coupled with the counter reverse gear 84. When the clutch CR is coupled with the counter reverse gear 84, since the gear 84 is engaged to the countershaft 68, the gear 84 rotates with the countershaft 68.

On the contrary, when the actuator 94 is supplied with the hydraulic oil in its oil chamber (for extension) 94*a*, it extends and moves the clutch CR upwardly to a neutral position where the clutch CR is coupled with no gears.

Figure 6:
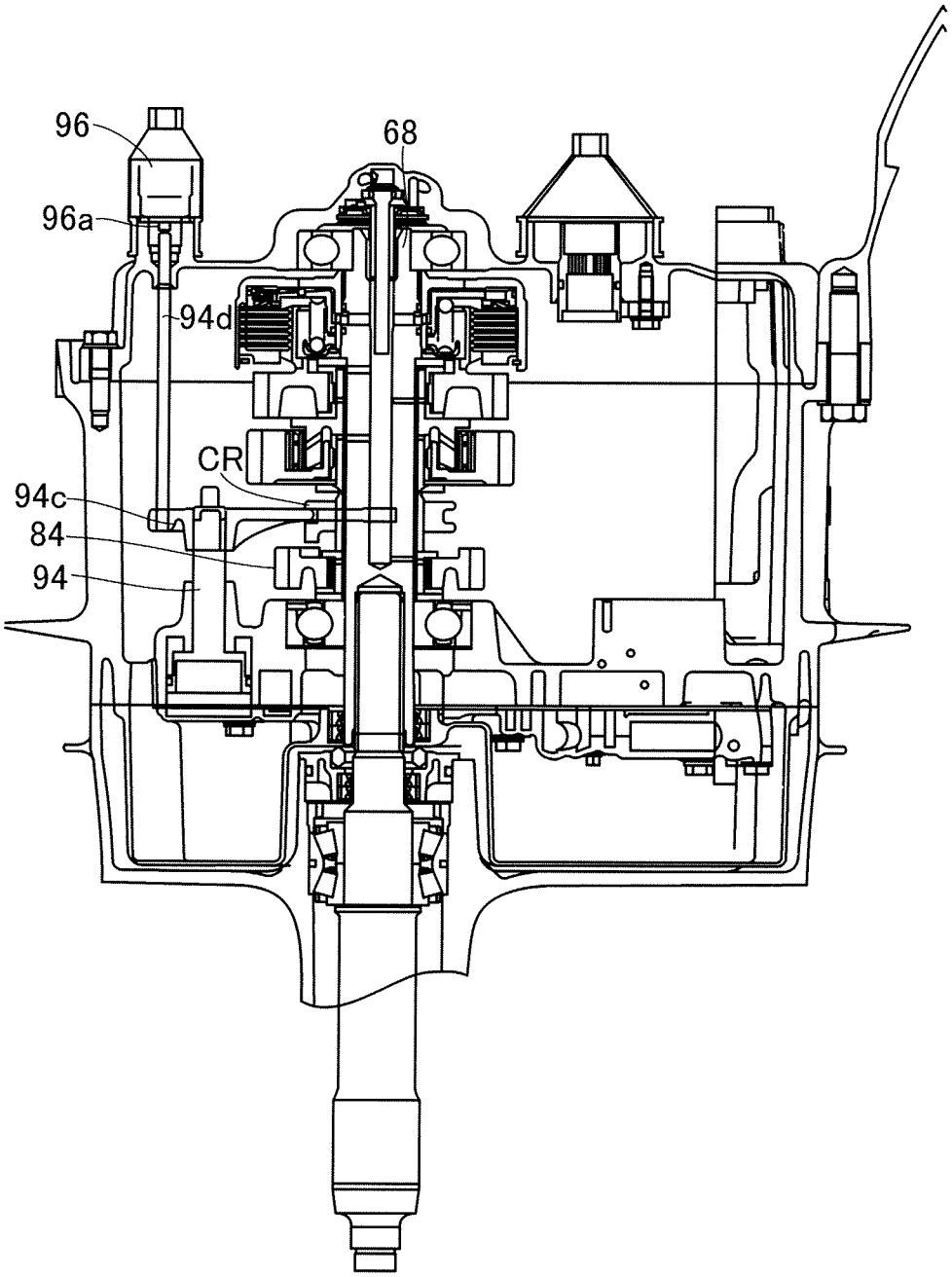
FIG. 6 is an enlarged sectional side view partially showing the outboard motor illustrated in FIG. 2.
Figure 7:
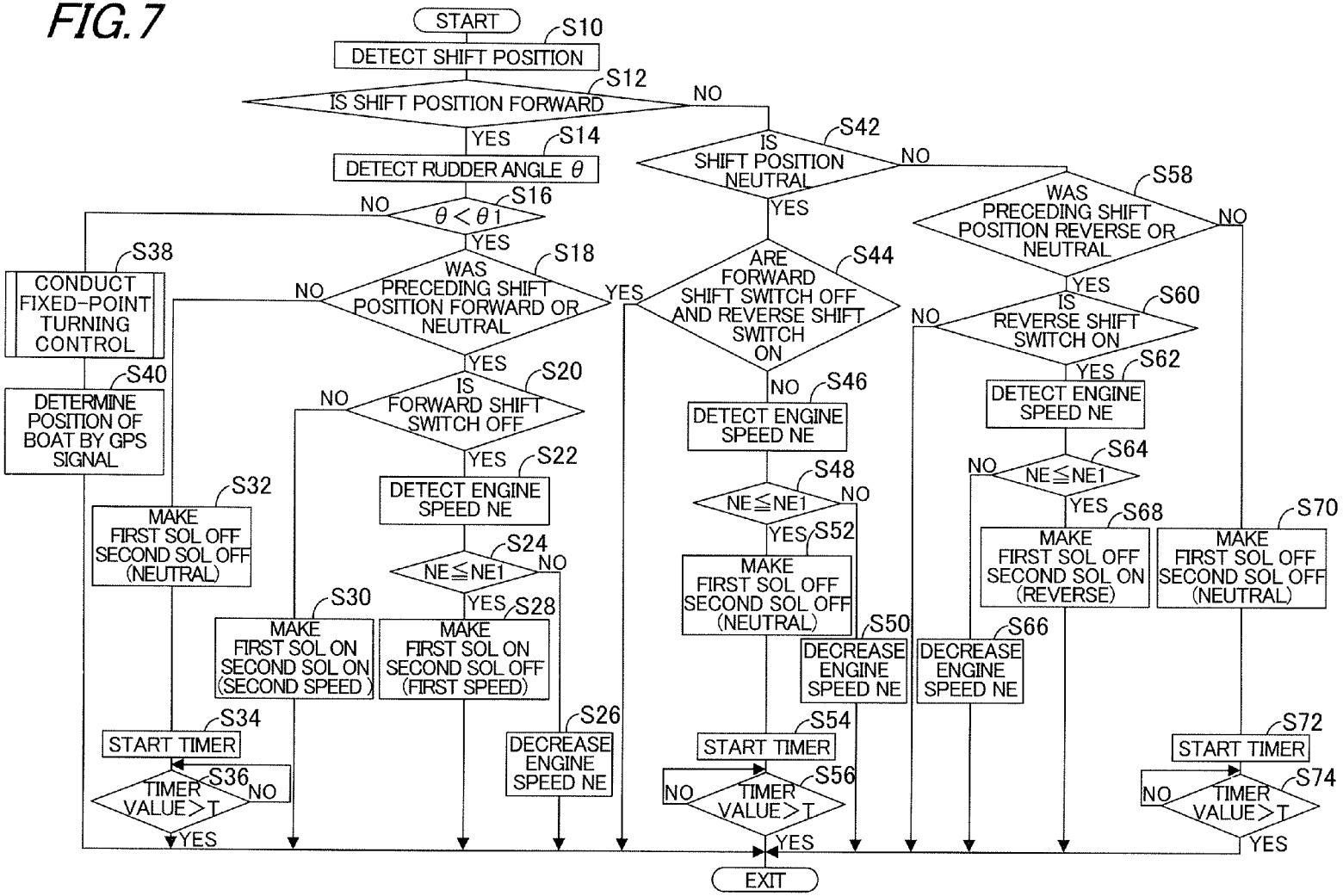
FIG. 7 is a flowchart showing the operation of the outboard motor control apparatus conducted by an Electronic Control Unit of an outboard motor illustrated in FIG. 1.

FIG. 6 is an enlarged sectional side view partially showing the outboard motor 10 illustrated in FIG. 2 and FIG. 7 is a reduced sectional plan view of the outboard motor 10 shown in FIG. 2.

As shown in the figure, a reverse shift switch 96 is installed and produces a signal or output that indicates the coupling of the reverse gear clutch CR with the counter reverse gear 84.

The reverse shift switch 96 is installed at a location above the shift fork 94*c* of the reverse shift actuator 94 as shown in FIG. 6 and FIG. 7. Specifically, it is fastened to an upper distal end of an operation rod 94*d* that is connected to the shift fork 94*c* of the actuator 94 in parallel with the countershaft 68.

The reverse shift switch 96 has a head portion 96*a* at its lower side. Contrary to the first-speed gear shift switch 92, the head portion 96*a* is provided at a position in contact with the upper distal end of the operation rod 94*d* in such a manner that, when the reverse shift actuator 94 is contracted for the predetermined distance, the upper distal end of the operation rod 94*d* is displaced and is remote away from the head portion 96*a*.

The head portion 96*a* is also connected to a connector portion (not shown) housed in the reverse shift switch 96 and the connector portion produces an ON signal while the head portion 96*a* is kept in contact with the upper distal end of the operation rod 94*d*. However, in response to the displacement of the upper distal end of the operation rod 94*d* from the head portion, it discontinues the production of an ON signal and produces an (electrical) OFF signal or output. Thus, by monitoring the signal outputted from the switch 96, it becomes possible to determine whether the reverse gear clutch CR is coupled with the counter reverse gear 84.

Returning to the explanation of FIG. 4, when the main first-speed gear 76 rotatively supported on the main shaft 60 is engaged on the main shaft 60 by the first-speed gear clutch C1, the output of the engine 50 is transmitted to the propeller 22, via the main shaft 60, the main first-speed gear 76, the counter first-speed gear 82, and the countershaft 68, so that the first speed is established.

Alternatively, when the counter second-speed gear 80 rotatively supported on the countershaft 68 is engaged on the countershaft 68 by the second-speed gear clutch C2 while the first-speed gear clutch C1 has been coupled with the main first-speed gear 76 (during which the reverse gear CR is at a neutral position), the output of the engine 50 is transmitted to the propeller 22, via the main shaft 60, the main second-speed gear 74 nonrotatively supported on the main shaft 60, the counter second-speed gear 80, and the countershaft 68, so that the second speed is established.

Specifically, in order to establish the second speed, under a state in which the first-speed gear clutch C1 has been coupled with the main first-speed gear 76 such that the first speed has been established (i.e., the first speed was established in advance), the counter second-speed gear 80 need to be engaged on the countershaft 68 by the second-speed gear clutch C2.

As mentioned above, the counter first-speed gear 82 is installed with the one-way clutch 82*a* that releases the engagement of the countershaft 68 and counter first-speed gear 82 when the rotational speed of the main shaft 60 is equal to or greater than the predetermined rotational speed. With this, when the rotational speed of the main shaft 60 is relatively low, the main first-speed gear 76 and counter first-speed gear 82 transmit the output of the engine 50 to the propeller 22. When the rotational speed of the main shaft 60 is increased and becomes equal to or greater than the predetermined rotational speed, since the one-way clutch 82*a* releases the coupling so that the counter first-speed gear 82 idles relative to the countershaft 68, and the main second-speed gear 74 and the counter second-speed gear 80 transmit the output of the engine 50 to the propeller 22.

Further, when the counter reverse gear 84 rotatively supported on the countershaft 68 is engaged on the countershaft 68 by the reverse gear clutch CR, the output of the engine 50 is transmitted to the propeller 22, via the main shaft 60, the main reverse gear 78 nonrotatively supported on the main shaft 60, the counter reverse gear 84 and the countershaft 68 so that the reverse is established.

Furthermore, when the first-speed gear shift actuator 90 is contracted whereas the reverse shift actuator 94 is extended so that the first-speed gear clutch C1 and the reverse gear clutch CR are at their neutral position (at that time the second-speed gear clutch C2 is not engaged with the counter second-speed gear 80), the main shaft 60 and the countershaft 68 are not coupled together so that the neutral position is established.

Thus, the engagement of the gears and the shafts 60, 68 by the first-speed gear clutch C1, the second-speed gear clutch C2 and the reverse gear clutch CR is conducted by controlling the hydraulic pressure to be supplied from the oil pump 86 to the clutches C1, C2 and CR.

Explaining this in detail, the oil pump 86 driven by the engine 50 pumps the hydraulic oil retained in the oil pan 66*a* through an oil passage 100*a* via a strainer 102 and discharges a pressurized hydraulic oil from an outlet 86*a*. The pressurized hydraulic oil discharged from the outlet 86*a* is supplied on the one hand to a first switch valve 104*a* through an oil passages 100*b* and to a second switch valve 104*b* through an oil passage 100*d*, and is supplied on the other hand to a first electromagnetic solenoid (linear solenoid) valve (hereinafter referred to as "first electromagnetic valve") 106*a* through an oil passage 100*c* branched off from the oil passage 100*b* and to a second electromagnetic solenoid (linear solenoid) valve (hereinafter referred to as "second electromagnetic valve") 106*b* through an oil passage 100*e* branched off from the oil passage 100*d*. The first and second electromagnetic valves 106, 106*b* have spools stored therein.

The first switch valve 104*a* is installed at the junction of the aforesaid oil passage 100*b* and other oil passages 100*f*, 100*g* connecting the oil pump 86 to the first-speed gear shift actuator 90. Specifically, the first switch valve 104*a* is connected to an oil chamber 90*a* of the first-speed gear shift actuator 90 through the oil passage 100*f*, and is connected to an oil chamber 90*b* of the actuator 90 through the oil passage 100*g*.

The second switch valve 104*b* is installed at the junction of the aforesaid oil passages 100*b*, 100*d* and other oil passages 100*h*, 100*i*, 100*m*, 100*n* connecting the oil pump 86 to the second-speed gear clutch C2 and the reverse shift actuator 94. Specifically, the second switch valve 104*b* is connected to an oil chamber 94*a* of the reverse shift actuator 94 through the oil passage 100*h*, is connected to an oil chamber 94*b* of the actuator 90 through the oil passage 100*i*, 100*m*, and is connected to the second-speed gear clutch C2 through the oil passage 100*i*, 100*n*.

The first and second switch valves 104*a*, 104*b* have spools that are displaceably stored therein. Each of the spools is provided with a spring at one end (left in the figure) that urged the spool toward the opposite (other) end, and is connected at the opposite end to the first or second electromagnetic valve 106*a* or 106*b* through the oil passage 100*j* or 100*k* at the opposite end.

When the first electromagnetic valve 106*a* is made ON (energized), its spool is displaced to connect the oil passage 100*c* and 100*j* and the hydraulic oil supplied from the oil pump 86 through the oil passage 100*c* is outputted to the opposite end of the first switch valve 104*a* through the oil passage 100*j*.

With this, the spool of the first switch valve 104*a* is displaced toward the one end, and the hydraulic oil in the oil passage 100*b* flows to the oil passage 100*f* and to the oil chamber 90*a* of the first-speed gear shift actuator 90. The actuator 90 is extended when supplied with the hydraulic oil in the oil chamber 90*a* and moves the first-speed gear clutch C1 upwardly through the shift fork 90*c*.

On the other hand, when the first electromagnetic valve 106*a* is made OFF (de-energized), its spool is not displaced so that the oil passage 100*c* and 100*j* are not connected and the hydraulic oil of the oil passage 100*c* is not outputted to the opposite end of the first switch valve 104*a*.

Accordingly, the spool of the first switch valve 104*a* is kept urged toward the opposite end and hence, the hydraulic oil in the oil passage 100*b* flows to the oil passage 100*g* and to the oil chamber 90*b* of the first-speed gear shift actuator 90. The actuator 90 is contracted and the first-speed gear clutch C1 is at the neutral position.

Similar to the first electromagnetic valve 106*a*, the spool of the second electromagnetic valve 106*b* is displaced when made ON (energized) and the hydraulic oil supplied from the oil pump 86 through the oil passage 100*e* is outputted to the opposite end of the second switch valve 104*b* through the oil passage 100*k*.

With this, the spool of the second switch valve 104*b* is displaced toward the one end, and the hydraulic oil in the oil passage 100*d* flows to the oil passage 100*i* and to a third switch valve 104*c*.

On the other hand, when the second electromagnetic valve 106*b* is made OFF (de-energized), its spool is not displaced so that the hydraulic oil of the oil passage 100*e* is not applied to the opposite end of the first switch valve 104*a* and its spool is kept urged toward the opposite end by the spring. Accordingly, the hydraulic oil of the oil passage 100*d* is supplied to the oil chamber 94*a* of the reverse shift actuator 94 through the oil passage 100*h*. The actuator 94 is extended and the reverse gear clutch CR is at the neutral position.

The third switch valve 104*c* is installed at the junction of the aforesaid oil passages 100*i*, 100*m*, 100*n* connecting the second switch valve 104*b* to the reverse shift actuator 94 or the second-speed gear clutch C2. Specifically, the third switch valve 104*c* is connected to the oil chamber 94*b* of the reverse shift actuator 94 through the oil passage 100*m*, and is connected to the second-speed gear clutch C2 through the oil passage 100*n*.

The third switch valves 104*c* has a spool that is displaceably stored therein. The spool is provided with a spring at one end (left in the figure) that urges the spool toward the opposite end, and is connected to an oil passage 100*l* at the opposite end.

In addition to the second electromagnetic valve 106*a*, when the first electromagnetic valve 106*a* is also made ON (energized), and the spool on the first switch valve 104*a* is displaced toward the one end to discharge the hydraulic oil to the oil passage 100*f*, a part of the hydraulic oil is outputted to the opposite end of the third switch valve 104*c* through the oil passage 100*l*. With this, the spool of the third switch valve 104*c* is displaced toward the one end, and the hydraulic oil in the oil passage 100*i* flows to the second-speed gear clutch C2 through the oil passage 100*n* so that the second-speed gear clutch C2 is engaged with the counter second-speed gear 80.

On the other hand, when the first electromagnetic valve 106*a* is made OFF (de-energized), the spool of the first switch valve 104*a* is not displaced so that the hydraulic oil in the oil passage 100*l* is not applied to the opposite end of the third switch valve 104*c*. Accordingly, the spool of the third switch valve 104*c* is kept urged toward the one end and hence, the hydraulic oil from the oil passage 100*i* flows to the oil passage 100*m* and to the oil chamber 94*b* of the reverse shift actuator 94 to move the reverse gear clutch CR downwardly.

As mentioned above, when the first electromagnetic valve 106*a* is made ON, but the second electromagnetic valve 106*b* is made OFF, the first-speed gear shift actuator 90 is supplied with the hydraulic oil in its oil chamber 90*a*, while the second-speed gear clutch C2 is not supplied with the hydraulic oil, the main first-speed gear 76 is engaged on the main shaft 60 by the first-speed gear clutch C1, so that the first speed is established. At this time, since the reverse shift actuator 94 is supplied with the hydraulic oil in its oil chamber 94*a* and is extended, the reverse gear clutch CR is not engaged with the counter reverse gear 84 and is at the neutral position.

When the first and second electromagnetic valves 106*a*, 106*b* are made ON, since the oil chamber 90*a* of the first-speed gear shift actuator 90 and the second-speed gear clutch C2 are supplied with the hydraulic oil, the main first-speed gear 76 is engaged on the main shaft 60 by the first-speed gear clutch C1 and the counter second-speed gear 80 is engaged on the countershaft 68 by the second-speed gear clutch C2, so that the second speed is established.

When the first electromagnetic valve 106*a* is made OFF, but the second electromagnetic valve 106*b* is made ON, since the first-speed gear shift actuator 90 is supplied with the hydraulic oil in its chamber 90*b*, the reverse shift actuator 94 is supplied with the hydraulic oil in its oil chamber 94*b*, but the second-speed gear clutch C2 is not supplied with the hydraulic oil, the counter reverse gear 84 is engaged on the countershaft 68 by the reverse gear clutch CR, so that the reverse is established.

When the first and second electromagnetic valves 106*a*, 106*b* are made OFF, since the first-speed gear shift actuator 90 and reverse shift actuator 94 are supplied with the hydraulic oil in their oil chambers 90*b*, 94*a*, the first-speed gear clutch C1 and reverse gear clutch CR are at their neutral positions. And since the second-speed gear clutch C2 is not supplied with the hydraulic oil, the main shaft 60 and the countershaft 68 are not engaged together and hence, become neutral.

The transmission 24 is selected or switched its position among the forward, neutral and reverse and any gear in the forward by controlling ON/OFF of the first and second electromagnetic valves 106*a*, 106*b* in the shift control.

The hydraulic oil pressurized by the oil pump 86 is supplied to lubricant-requiring portions such as the main shaft 60, the countershaft 68, etc., through the oil passage 100*b*, an oil passage 100*o*, a regulator valve 108 and a relief valve 110. An emergency valve 112 is provided at an oil passage 100*p* that bypasses the first switch valve 104*a*, first electromagnetic valve 106*a* and third switch valve 104*c*. The emergency valve 112 comprises a manually operated valve that allows the user shift gears in case of emergency.

Returning to the explanation of FIG. 3, a throttle opening sensor 120 is installed near the throttle valve 56 and produces an output or signal indicative of throttle opening TH of the throttle valve 56. A crank angle sensor (engine speed detector) 122 is installed near the crankshaft of the engine 50 and produces a pulse signal at every predetermined crank angle. A trim angle sensor 124 is installed near the tilting shaft 16 and produces an output or signal corresponding to a trim angle θ of the outboard motor 10.

The outputs of the sensors 120, 122, 124 are sent to the ECU 20. The ECU 20 and the sensors including those mentioned above (the steering angle sensor 32, etc.) and the GPS receiver 38 are connected through a standard communication such as authorized by the National Marine Electronics Association, more specifically Controller Area Network.

The ECU 20 conducts, in addition to the shift control of the transmission 24 mentioned above, trim angle control to control the trim angle of the trim unit 26, throttle opening control to control the throttle opening TH by operating the throttle electric motor 58, engine control to control fuel injection and ignition timing of the engine 50.

The ECU 20 also conducts control of the transmission 24 constituted as a Drive-By-Wire fashion in which the mechanical connection between the operation system (including the steering wheel 30 and shift/throttle lever 34) and the outboard motor 10 is cut out.

It should be noted that the ECU 20 of the first outboard motor 10A and that of the second outboard motor 10B are connected with each other so that one can communicate with the other.

FIG. 7 is a flowchart showing the operation of the outboard motor control apparatus, i.e., operation conducted in parallel by the ECUs 20 of the first and second outboard motor 10A, 10B. The illustrated program is executed independently by the respective ECUs 20 of the first and second outboard motors 10A, 10B at predetermined intervals, e.g., 100 milliseconds.

The program begins at S10, in which the shift position is detected or determined from the output of the shift position sensor 36. Specifically, the position is detected by determining which position among the forward, neutral and reverse the output voltage of the shift position sensor 36 is corresponding to.

More specifically, it is detected or determined that the position is forward when the sensor output voltage is greater than a predetermined first value (e.g., 3V), is neutral when the sensor output voltage is equal to or smaller than the predetermined first value, but is greater than a predetermined second value (e.g., 2V), and is reverse when the sensor output voltage is equal to or less than the predetermined second value.

The program then proceeds to S12, in which it is determined whether the detected shift position is the forward and if the result is affirmative, the program proceeds to S14, in which the rudder angle θ of the outboard motor 10 relative to the hull 12 is detected from the output of the rudder angle sensor 40.

The program then proceeds to S16, in which it is determined whether the detected rudder angle θ (specifically the angle of either of the first and second outboard motors 10A, 10B) is smaller than a predetermined angle θ1. The predetermined angle θ1 is set to a value, e.g., 15 degrees to make it possible to presume whether the operator intends to make the boat 1 turn.

The result in S16 is naturally affirmative in the first program loop and the program proceeds to S18, in which it is determined whether the shift position in the preceding (last) program loop was the forward or neutral.

When the result in S18 is affirmative, i.e., when it is determined that the shift position is changed from neutral to forward or remains unchanged, the program proceeds to S20, in which it is determined whether the forward shift switch 92 (shown as "FWD SHIFT SW" in the figure) is made OFF, in other words it is determined whether it is under a situation in which the first-speed gear clutch C1 is not coupled with the main first-speed gear 76.

When the result in S20 is affirmative, the program proceeds to S22, in which the engine speed NE is detected by measuring the intervals of the pulses outputted from the crank angle sensor 122, and to S24, in which it is determined whether the detected engine speed NE is equal to or smaller than a predetermined first speed NE1. The predetermined first speed NE1 is set to be an engine speed (e.g., 800 rpm) normally used in the trolling.

When the result in S24 is negative, the program proceeds to S26, in which the engine speed NE is decreased to the predetermined first speed NE1 to mitigate shock in shifting. Specifically, this is done by retarding the ignition timing or by decreasing the quantity of fuel injection to be supplied to the engine 50 in accordance with a routine not shown.

On the other hand, when the result in S24 is affirmative, the program proceeds to S28, in which the first electromagnetic valve (shown as "FIRST SOL" in the FIG. 106*a* is made ON, while the second electromagnetic valve (shown as "SECOND SOL" in the FIG. 106*b* is made OFF to shift the gears of the transmission 24 to the first speed.

When the gears are shifted to the first speed in S28, the first-speed gear clutch C1 is coupled with the main first-speed gear 76 and the forward shift switch 92 is made ON. Accordingly, the result in S20 in the next program loop becomes negative and the program proceeds to S30, in which the first and second electromagnetic valves 106*a*, 106*b* are both made ON to shift the gears of the transmission 24 to the second speed.

When the result in S18 is negative, i.e., when it is determined that the shift position is changed from reverse to forward, the program proceeds to S32, in which the first and second electromagnetic valves 106*a*, 106*b* are both made OFF to shift to the neutral position.

The program next proceeds to S34, in which a timer is started to start time measurement and proceeds to S36, in which it is determined whether the value of the timer is greater than a predetermined time period T (e.g., one second) and if it is, the program is terminated. Thus, when the shift position is changed from reverse to forward, the position is once shifted to neutral (S32 to S34) and the neutral position is kept for the predetermined time period T (S34, S36).

On the other hand, when the result in S16 is negative, i.e., when it is determined that the detected rudder angle θ (of either of the first and second outboard motors 10A, 10B) is equal to or greater than the predetermined angle θ1, the program proceeds to S38, in which control on turning of the boat 1 about a same point is conducted, and to S40, in which the position of the boat 1 is determined or detected by the GPS signal, i.e., is determined from the output of the GPS receiver 38 and the determined position of the boat 1 is stored in the RAM. The turning mentioned in S38 is hereinafter referred to as "fixed-point turning" and the point is hereinafter referred to as "fixed point".

Specifically, the position of the boat 1 at a time of starting the fixed-point turning is determined from the output of the GPS receiver 38 and is stored in the RAM of the ECU 20, and the operation of the outboard motors 10A, 10B are controlled in such a manner that the position of the boat 1 is kept within a predetermined range (distance) about the fixed point.

More precisely, when the detected rudder angle θ becomes equal to or greater than the predetermined angle θ1, it is determined that the fixed-point turning should be started. Accordingly, the position of the boat 1 at that time is determined from the output of the GPS receiver 38, and the determined position is updated at prescribed intervals.

Here, it is assumed that the boat 1 makes the fixed-point turning counterclockwise (when viewed from the above) so that the first outboard motor 10A is the inner motor and the second outboard motor 10B is the outer motor in the boat 1, and that the turning is performed by changing the shift position of the first outboard motor 10A to reverse and that of the second outboard motor 10B to forward.

Figure 8:
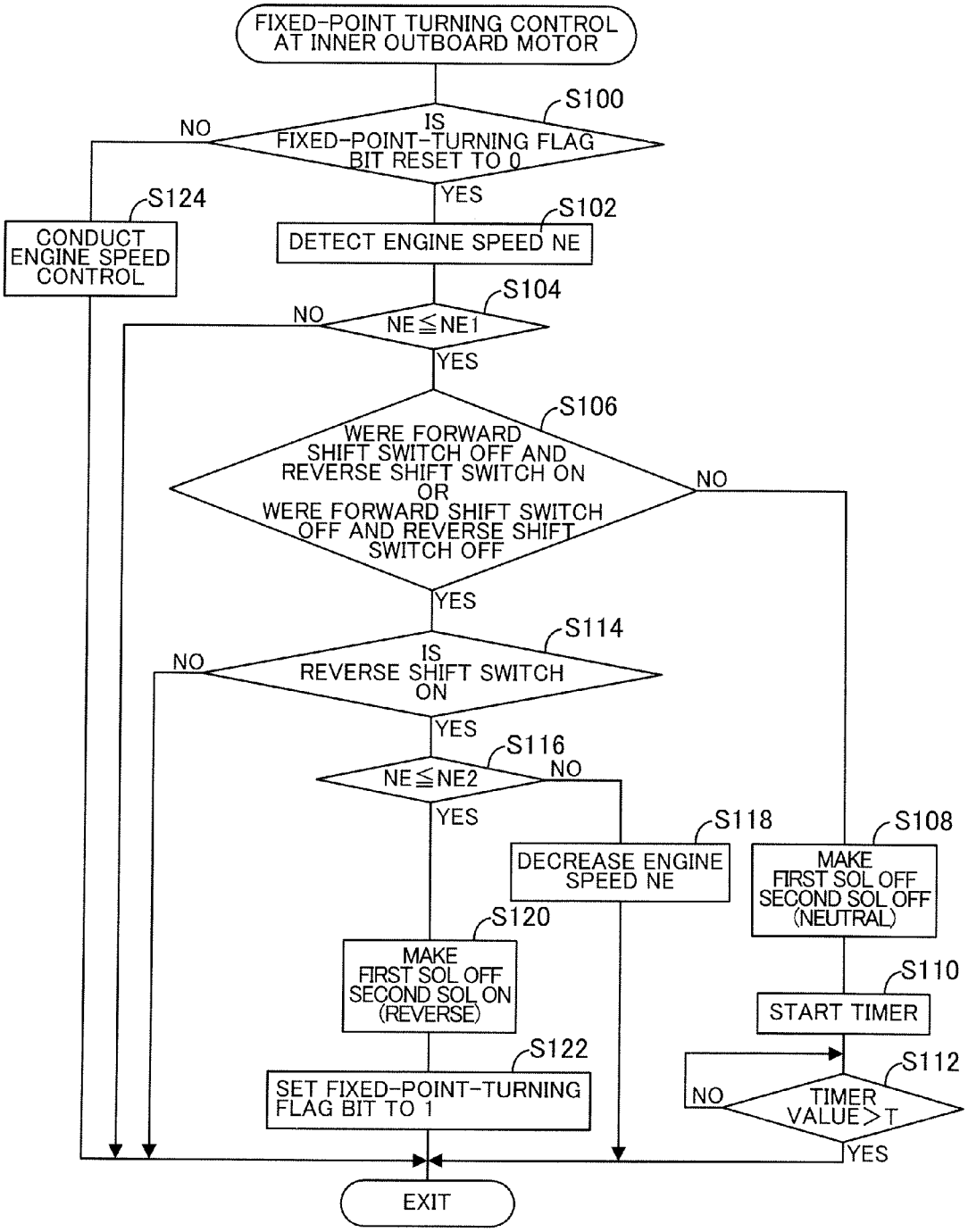
FIG. 8 is a flowchart showing the subroutine of the control shown in FIG. 7 to be conducted at the ECU of the first outboard motor in the inner side.
Figure 9:
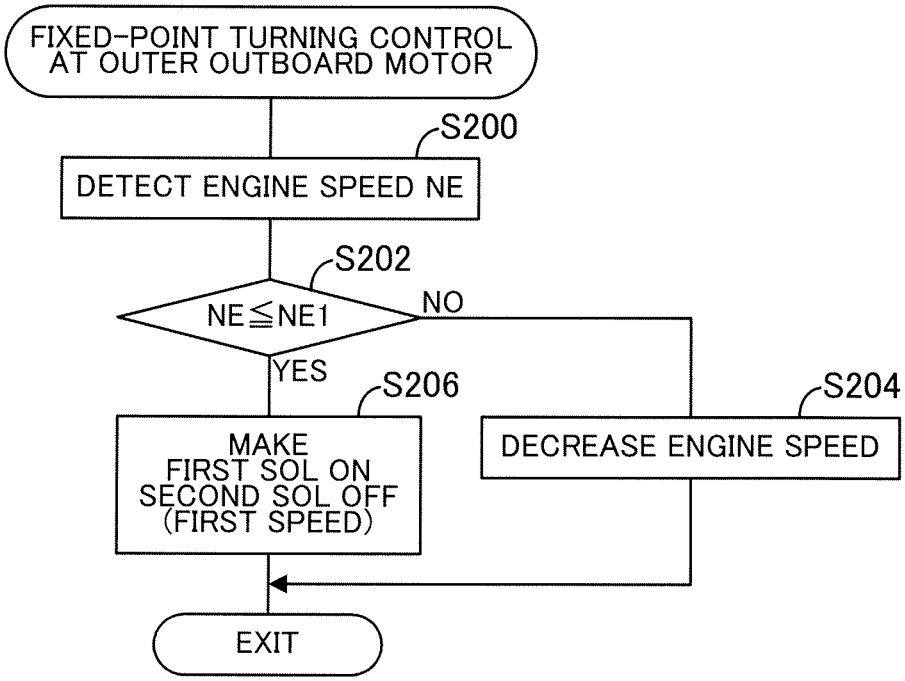
FIG. 9 is a flowchart showing subroutine of the control shown in FIG. 7 to be conducted at the ECU of the second outboard motor in the outer side.

FIG. 8 is a flowchart showing the subroutine of the control on the fixed-point turning illustrated in the flowchart of FIG. 7 to be conducted at the ECU 20 of the first outboard motor 10A in the inner side, and FIG. 9 is a flowchart showing that to be conducted at the ECU 20 of the second outboard motor 10B in the outer side.

Explaining the flowchart of FIG. 8 first, the program begins in S100, in which it is determined whether the bit of a fixed-point-turning flag is reset to 0. The bit of the flag is initially reset to 0, and is set to 1 when the shift position of the inner motor 10A is made reverse as mentioned below.

The result in S100 is normally affirmative and the program proceeds to S102, in which the engine speed NE is detected, and proceeds to S104, in which it is determined whether the detected engine speed NE is equal to or smaller than the predetermined first speed NE1. When the result in S104 is negative, the program is immediately terminated.

On the other hand, when the result in S104 is affirmative, the program proceeds to S106, in which it is determined whether the forward shift switch 92 was made OFF and the reverse shift switch (shown as "RVS SHIFT SW" in the FIG. 96 was made ON, or whether the forward shift switch 92 and the reverse shift switch 96 were both made OFF in the preceding program loop. If the data of the preceding loop does not exist in the first program loop, the data of the current program loop can instead be used.

When the result in S106 is negative, i.e., when it is determined that the forward shift switch 92 is made ON, for example, the program proceeds to S108, in which the first and second electromagnetic valves 106*a*, 106*b* are made OFF to change the shift position to neutral, to S110, in which the timer is started to start time measurement and proceeds to S112, in which it is determined whether the value of the timer is greater than the predetermined time period T and if it is, the program is terminated in the same manner as mentioned in S34, S36 in the flowchart of FIG. 7.

On the contrary, when the result in S106 is affirmative, the program proceeds to S114, in which it is determined whether the reverse shift switch 96 is made ON. When the result in S114 is negative, the program is immediately terminated. When the result in S114 is affirmative, the program proceeds to S116, in which it is determined whether the engine speed NE is equal to or smaller than a predetermined second speed NE2 (e.g., 650 rpm) set to be lower than the predetermined first speed NE1.

When the result in S116 is negative, the program proceeds to S118, in which the engine speed NE is decreased to the predetermined second speed NE2 in the same manner as mentioned in S26 in the flowchart of FIG. 7.

When the result in S116 is affirmative, the program proceeds to S120, in which the first electromagnetic valve 106*a* is made OFF, while the second electromagnetic valve 106*b* is made ON to change the shift position to reverse. Since the engine speed NE is decreased from the predetermined first speed NE1 to the predetermined second speed NE2, the gears of the transmission 24 can be changed to the reverse gears 78, 84 smoothly. The program next proceeds to S122, in which the bit of the fixed-point-turning flag is set to 1.

In the next program loop, the result in S100 is naturally negative and the program proceeds to S124, in which fixed-point-turning engine speed control is conducted.

Specifically, the engine speed NE of the first outboard motor 10A is controlled in such a way that the position of the boat 1 (detected by the GPS receiver 38) at the time of starting the fixed-point turning control is kept within a predetermined range about the fixed point. More specifically, since the center of turning of the boat 1 is liable to deviate from the fixed point or the radius of turning is apt to increase during the fixed-point turning is repeated, the engine speed NE is controlled to avoid this.

At the same time, when it is determined that the fixed-point turning control is to be made at S38 of the flowchart of FIG. 7, another engine control is conducted at the second outboard motor 10B.

Explaining it with reference to the flowchart of FIG. 9, the program begins in S200, in which the engine speed NE is detected, and proceeds to S202, in which it is determined whether the detected engine speed NE is equal to or smaller than the predetermined first speed NE1.

When the result in S202 is negative, i.e., when it is determined that the detected engine speed NE is greater than the predetermined first speed NE1, the program proceeds to S204, in which the engine speed NE is decreased to the predetermined speed NE1.

On the other hand, when the result in S202 is affirmative, the program proceeds to S206, in which the first electromagnetic valve 106*a* is made ON, while the second electromagnetic valve 106*b* is made OFF to shift the gears of the transmission 24 to the first speed.

Returning to the explanation of the FIG. 7 flowchart, when the result in S16 is affirmative, i.e., when the detected rudder angle θ becomes smaller than the predetermined angle θ1, the program proceeds to S18 to S36 as mentioned above, and operation of the first and second outboard motors 10A, 10B are controlled to transmit the power of the engine 50 to the propeller 22 through at least one of the forward first-speed gear and the second-speed gear, thereby enabling to return to usual navigation after the turning of the boat 1 smoothly.

Specifically, the operation of the first and second outboard motors 10A, 10B are controlled in such a manner that the speed of the engine NE of the first outboard motor 10A is equal to that of the second outboard motor 10B, thereby enabling to return to usual navigation after the turning of the boat 1 more smoothly.

In addition, when the result in S12 is negative, the program proceeds to S42, in which it is determined whether the shift position is neutral. When the result in S42 is affirmative, the program proceeds to S44, in which it is determined whether the forward shift switch 92 is made OFF and the reverse shift switch 96 is made ON. In other words, it is determined whether the first-speed gear clutch C1 is not coupled with the main first-speed gear 76 and the reverse gear clutch CR is not coupled with the counter reverse gear 84, i.e., it is determined whether both the first-speed gear clutch C1 and the reverse gear clutch CR are at their neutral positions.

When the result in S44 is affirmative, the program skips the processing in S46 to S56. But, when the result in S44 is negative, the program proceeds to S46, in which the engine speed NE is detected, and to S48, in which it is determined whether the detected engine speed NE is equal to or smaller than the predetermined first speed NE1.

When the result in S48 is negative, the program proceeds to S50, in which the engine speed NE is decreased to the predetermined first speed NE1. When the result in S48 is affirmative, the program proceeds to S52, in which the first and second electromagnetic valves 106*a*, 106*b* are made OFF to shift to the neutral position. The program then proceeds to S54, in which the timer is started and to S56, in which when it is determined that the timer value is greater than the predetermined time period T, the program is terminated.

When the result in S42 is negative, i.e., when the shift position is reverse, the program proceeds to S58, in which it is determined whether the shift position in the preceding program loop was reverse or neutral.

When the result in S58 is affirmative, the program proceeds to S60, in which it is determined the reverse shift switch 96 is made OFF. When the result in S60 is negative, the program skips processing in S62 to S68. When the result in S60 is affirmative, the program proceeds to S62, in which the engine speed NE is detected, and to S64, in which it is determined whether the detected engine speed NE is equal to or smaller than the predetermined first speed NE1.

When the result in S64 is negative, the program proceeds to S66, in which the engine speed NE is decreased to the predetermined first speed NE1. When the result in S64 is affirmative, the program proceeds to S68, in which the first electromagnetic valve 106*a* is made OFF and the second electromagnetic valve 106*b* is made ON, so that the position is shifted to reverse.

When the result in S58 is negative, i.e., when it is determined that the preceding position was forward, but the present position is reverse, in other words, when the shift position is shifted from forward to reverse, the program proceeds to S70, in which the first and second electromagnetic valves 106*a*, 106*b* are made OFF to change the shift position to neutral. The program then proceeds to S72, S74 in the same manner and is terminated.

Figure 10:
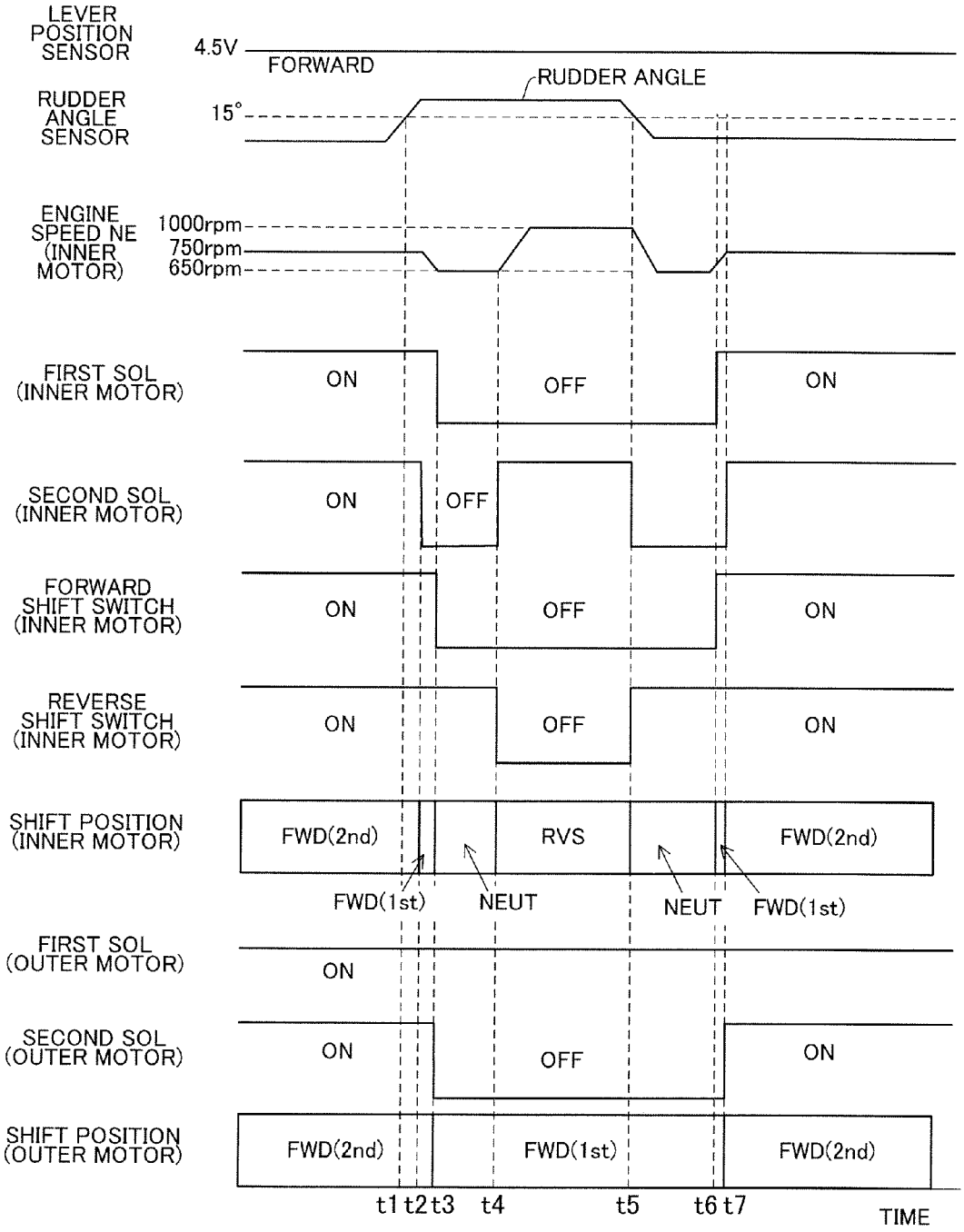
FIG. 10 is a time chart partially showing the control mentioned in the flowcharts of FIGS. 7 to 9.

FIG. 10 is a time chart partially showing the control mentioned above.

As shown in the figure, when it is determined that the rudder angle θ becomes equal to or greater than the predetermined angle 15 degrees (θ1; S16) and the engine speed NE is equal to or smaller than the predetermined first speed 750 rpm (NE1) used in the trolling (S104), the engine speed NE of the first outboard (inner) motor 10A is further decreased to the predetermined second speed 650 rpm (NE2) and the shift position is changed to reverse (S116 to S120), while the second outboard (outer) motor 10B is shifted down from the second to the first speed (S206). Then, the second outboard (outer) motor 10B is controlled to keep the engine speed NE at a time of starting the fixed-point turning (S38).

To be more specific, under a situation that the shift/throttle lever 34 is at the forward position where the output voltage of the lever position sensor 36 outputs 4.5 V that exceeds the predetermined first value (e.g., 3 V) indicative of the forward position, the gear positions of the first and second (inner and outer) outboard motors 10A, 10B are both at the second speed (the first and second electromagnetic valves 106*a*, 106*b* are both made ON (S12)), and the engine speed NE of the first outboard motor 10A is equal to or smaller than the predetermined first speed NE1 (e.g., 750 rpm), when the rudder angle θ becomes equal to or greater than the predetermined angle 15 degrees (θ1) at time t1 (S16), the second electromagnetic valve 106*b* of the first outboard motor 10A is then made OFF at time t2.

Then, at time t3, the engine speed NE is decreased to the predetermined second speed NE2 (e.g., 650 rpm) and the first electromagnetic valve 106*a* is made OFF to change the shift position to neutral (S38, S108, S118).

At the same time, the second electromagnetic valve 106*b* of the second outboard motor 10B is made OFF to shift the gears from the second to the first speed (S38, S206).

At time t4, the second electromagnetic valve 106*b* of the first outboard motor 10A is made ON to change the shift position to reverse and the engine speed control is conducted (S38, S120-S124).

At time t5, the second electromagnetic valve 106*b* of the first outboard motor 10A is made OFF to change the shift position to neutral when the rudder angle θ becomes smaller than the predetermined angle θ1.

At time t6, the first electromagnetic valve 106*a* of the first outboard motor 10A is made ON to shift the gears to the first speed.

At time t7, the second electromagnetic valve 106*b* of the first outboard motor 10A is also made ON to shift the gears from the first to the second speed. At this time, the second electromagnetic valve 106*b* of the second outboard motor 10B is also made ON to shift the gears from the first to the second speed.

As a result, the first and second outboard motors 10A, 10B are both shifted to the second speed and the operation of the motors 10A, 10B return to usual navigation.

Although not illustrated in the figure, when the rudder angle θ becomes smaller than the predetermined angle θ1 at time t5, the first and second outboard motors 10A, 10B are controlled in such a manner that their engine speeds NE become equal to each other so as the boat 1 to return immediately to a straight forward advance.

As stated above, the embodiment is configured to have an apparatus (and method) for controlling operation of a plurality of outboard motors (10, 10A, 10B) adapted to be mounted on a stern (12*a*) of a hull (12) of a boat (1) side by side and each equipped with an internal combustion engine (50) to power a propeller (22) through a power transmission shaft (main shaft 60, propeller shaft 62, counter shaft 68) and a transmission (24) having at least a forward first-speed gear (main first-speed gear 76, counter first-speed gear 82) and a second-speed gear (main second-speed gear 74, counter second-speed gear 80) and a reverse gear (main reverse gear 78, counter reverse gear 84) each supported on the power transmission shaft, comprising: an engine speed detector (ECU 20, crank angle sensor 122, S38, S102) that detects a speed of the engine NE of a first one (10A) of the outboard motors situated at inner side at turning of the boat; a rudder angle detector (ECU 20, rudder angle sensor 40, S14) that detects a rudder angle θ of at least one of the outboard motors including the first one (10A) and a second one (10B) situated at outer side at the boat turning; a controller (ECU 20, S16, S38, S40, S100-S124, S200-S206) that conducts control of the boat turning to operate the first one (10A) of the outboard motors to transmit a power of the engine to the propeller through the reverse gear, and to operate the second one (10B) of the outboard motors to transmit the power of the engine to the propeller through the forward first-speed gear, when the detected engine speed is equal to or smaller than a predetermined first speed NE1 and the detected rudder angle is equal to or greater than a predetermined angle θ1. With this, it becomes possible to facilitate to make rapid turning or repeated turning of the boat 1 about a same point.

In the apparatus (and method), the controller operates the first one (10A) of the outboard motor to decrease the speed of the engine to a predetermined second speed NE2 set lower than the predetermined first speed NE1 and conducts the control of the boat turning, when the detected engine speed is equal to or smaller than the predetermined first speed NE1 and the detected rudder angle is equal to or greater than the predetermined angle θ1 (S16, S38, S104, S116, S118). With this, in addition to the effects mentioned above, it becomes possible to change to the reverse gears 78, 84 smoothly in the transmission 24 of the first outboard motor 10A, thereby enabling to make the shift position of the first outboard motor 10A to reverse, thereby facilitating to make rapid turning or repeated turning of the boat 1 about a same point.

In the apparatus (and method), the controller operates the second one (10B) of the outboard motors to keep the speed of the engine, when the detected engine speed is equal to or smaller than the predetermined first speed NE1 and the detected rudder angle is equal to or greater than the predetermined angle θ1 (S16, S38, S202, S206). With this, it becomes possible to make rapid turning or repeated turning of the boat 1 about a same point more easily.

The apparatus (and method) further includes: a boat position detector (GPS receiver 38, ECU 20) that detects a position of the boat (1) in a navigation course; and the controller conducts the control of the boat turning to operate the first one (10A) of the outboard motors to regulate the speed of the engine based on the detected position of the boat (1) after the speed of the engine was decreased to the predetermined second speed NE2 (S16, S38, S122, S100, S124). With this, it becomes possible to make the repeated turning of the boat 1 about a same point more easily.

In the apparatus (and method), the controller terminates the control of the boat turning when the detected rudder angle becomes smaller than the predetermined angle θ1 and controls operation of the first one (10A) and the second one (10B) of the outboard motors to transmit the power of the engine to the propeller through at least one of the forward first-speed gear and the second-speed gear (S16-S36). With this, it becomes possible to return to usual navigation after the turning of the boat 1 smoothly.

In the apparatus (and method), the controller controls operation of the first one (10A) and the second one (10B) of the outboard motors in such a manner that the speed of the engine of the first one is equal to that of the second one when the detected rudder angle becomes smaller than the predetermined angle θ1 (S16-S36). With this, it becomes possible to return to usual navigation after the turning of the boat 1 more smoothly.

In the apparatus (and method), the controller controls shift position of the transmission (24) of the first one (10A) of the outboard motors to neutral before conducting the control of the boat turning and after terminating the control of the boat turning (S108-S112, S32-S36). With this, it becomes possible to facilitate to make rapid turning or repeated turning of the boat 1 more smoothly.

It should be noted that, although this invention has been mentioned for the outboard motor exemplified above, this invention can be applied to an inboard motor equipped with the same transmission.

It should further be noted that, although the invention has been described for the boat 1 installed with two outboard motors, the invention can be applied to a boat installed with three or more outboard motors.

It should further be noted that, although the engine speed is determined in the processing of the flowcharts of FIGS. 8 and 9 for the outboard motor 10A or 10B concerned, an average value of the two outboard motors 10A, 10B can instead be used.

It should further be noted that, although various specific values are mentioned in the above as the predetermined values, they are examples and should not be limited thereto.

Japanese Patent Application No. 2012-252734 filed on Nov. 16, 2012, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of a plurality of outboard motors adapted to be mounted on a stern of a hull of a boat side by side, wherein each of the plurality of outboard motors comprises an internal combustion engine to power a propeller through a power transmission shaft and a transmission, the transmission including gears to shift the transmission to a forward first-speed, a forward second-speed and a reverse, the apparatus comprising:

an engine speed detector that detects a speed of the engine of a first one of the outboard motors situated at inner side at turning of the boat;

a rudder angle detector that detects a rudder angle of at least one of the outboard motors including the first one and a second one situated at outer side at the boat turning; and a controller that conducts control of the boat turning to operate the first one of the outboard motors to shift the transmission to the reverse and to transmit a power of the engine to the propeller through the shifted transmission, and to operate the second one of the outboard motors to shift the transmission to the forward first-speed and to transmit the power of the engine to the propeller through the shifted transmission when the transmissions of the outboard motors are at the forward second-speed, the detected engine speed is equal to or smaller than a predetermined first speed and the detected rudder angle is equal to or greater than a predetermined angle.

2. The apparatus according to claim 1, wherein the controller operates the first one of the outboard motors to decrease the speed of the engine to a predetermined second speed set lower than the predetermined first speed and conducts the control of the boat turning when the detected engine speed is equal to or smaller than the predetermined first speed and the detected rudder angle is equal to or greater than the predetermined angle.

3. The apparatus according to claim 2, wherein the controller operates the second one of the outboard motors to keep the speed of the engine when the detected engine speed is equal to or smaller than the predetermined first speed and the detected rudder angle is equal to or greater than the predetermined angle.

4. The apparatus according to claim 2, further including:

a boat position detector that detects a position of the boat in a navigation course of the boat;

and the controller conducts the control of the boat turning to operate the first one of the outboard motors to regulate the speed of the engine based on the detected position of the boat after the speed of the engine was decreased to the predetermined second speed.

5. The apparatus according to claim 1, wherein the controller terminates the control of the boat turning when the detected rudder angle becomes smaller than the predetermined angle, shifts the transmission to the forward second-speed and controls operation of the first one and the second one of the outboard motors to transmit the power of the engine to the propeller through the shifted transmission.

6. The apparatus according to claim 5, wherein the controller controls operation of the first one and the second one of the outboard motors in such a manner that the speed of the engine of the first one is equal to that of the second one when the detected rudder angle becomes smaller than the predetermined angle.

7. The apparatus according to claim 1, wherein the controller controls a shift position of the transmission of the first one of the outboard motors to neutral before conducting the control of the boat turning and after terminating the control of the boat turning.

8. A method for controlling operation of a plurality of outboard motors adapted to be mounted on a stern of a hull of a boat side by side, wherein each of the plurality of outboard motors comprises an internal combustion engine to power a propeller through a power transmission shaft and a transmission, the transmission including gears to shift the transmission to a forward first-speed, a forward second-speed and a reverse, the method comprising the steps of:

detecting a speed of the engine of a first one of the outboard motors situated at inner side at turning of the boat;

detecting a rudder angle of at least one of the outboard motors including the first one and a second one situated at outer side at the boat turning; and conducting control of the boat turning to operate the first one of the outboard motors to shift the transmission to the reverse and to transmit a power of the engine to the propeller through the shifted transmission, and to operate the second one of the outboard motors to shift the transmission to the forward first-speed to transmit the power of the engine to the propeller through the shifted transmission when the transmissions of the outboard motors are at the forward second-speed, the detected engine speed is equal to or smaller than a predetermined first speed and the detected rudder angle is equal to or greater than a predetermined angle.

9. The method according to claim 8, wherein the step of controlling operates the first one of the outboard motors to decrease the speed of the engine to a predetermined second speed set lower than the predetermined first speed and conducts the control of the boat turning when the detected engine speed is equal to or smaller than the predetermined first speed and the detected rudder angle is equal to or greater than the predetermined angle.

10. The method according to claim 9, wherein the step of controlling operates the second one of the outboard motors to keep the speed of the engine when the detected engine speed is equal to or smaller than the predetermined first speed and the detected rudder angle is equal to or greater than the predetermined angle.

11. The method according to claim 9, further including the step of:

detecting a position of the boat in a navigation course;

and the step of controlling conducts the control of the boat turning to operate the first one of the outboard motors to regulate the speed of the engine based on the detected position of the boat after the speed of the engine was decreased to the predetermined second speed.

12. The method according to claim 8, wherein the step of controlling terminates the control of the boat turning when the detected rudder angle, shifts the transmission to the forward second-speed becomes smaller than the predetermined angle and controls operation of the first one and the second one of the outboard motors to transmit the power of the engine to the propeller through the shifted transmission.

13. The method according to claim 12, wherein the step of controlling controls operation of the first one and the second one of the outboard motors in such a manner that the speed of the engine of the first one is equal to that of the second one when the detected rudder angle becomes smaller than the predetermined angle.

14. The method according to claim 8, wherein the step of controlling controls a shift position of the transmission of the first one of the outboard motors to neutral before conducting the control of the boat turning and after terminating the control of the boat turning.

* * * * *